United States Patent [19]

Nakada

[11] 4,083,284

[45] Apr. 11, 1978

[54] DELAYED VIBRATO ARRANGEMENT FOR AN ELECTRONIC MUSICAL INSTRUMENT

[75] Inventor: Akira Nakada, Hamamatsu, Japan

[73] Assignee: Nippon Gakki Seizo Kabushiki Kaisha, Japan

[21] Appl. No.: 787,149

[22] Filed: Apr. 13, 1977

[30] Foreign Application Priority Data

Apr. 16, 1976 Japan ..... 51-47747[U]

[51] Int. Cl.[2] ..... G10H 1/04

[52] U.S. Cl. ..... 84/1.25; 84/1.01; 84/1.13; 84/1.24

[58] Field of Search ..... 84/1.01, 1.13, 1.24, 84/1.25, 1.26; 179/1 J; 331/178

[56] References Cited

U.S. PATENT DOCUMENTS

| | | | |
|---|---|---|---|
| 2,817,708 | 12/1957 | Fender | 179/1 J |
| 2,899,644 | 8/1959 | Leslie | 84/1.25 X |
| 3,288,907 | 11/1966 | George | 84/1.25 |
| 3,973,463 | 8/1976 | Schreier | 84/1.25 |

*Primary Examiner*—Ulysses Weldon
*Attorney, Agent, or Firm*—Flynn & Frishauf

[57] ABSTRACT

A delayed vibrato signal generating arrangement in which an envelope signal which changes from a first potential level to a second potential level at the instant of key depression, and thereafter varies gradually from the second potential level to the first potential level is generated by an envelope signal generator, the peak portion of such envelope signal is clipped off by a clipper, and then a vibrato signal with a gradually increasing amplitude is generated by a vibrato signal generator driven by the output of the clipper. The vibrato signal generator is so arranged as not to operate at the clipped level of the output of the clipper, thereby giving a delay time for delayed vibrato.

14 Claims, 6 Drawing Figures

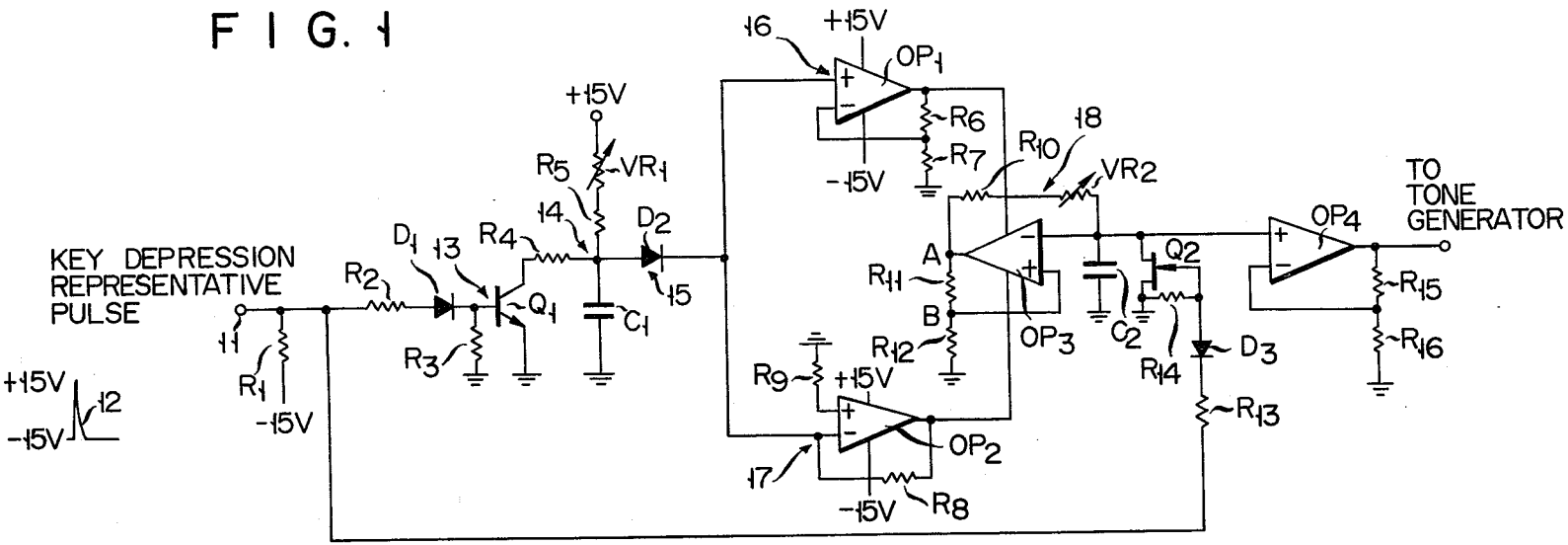
FIG. 1
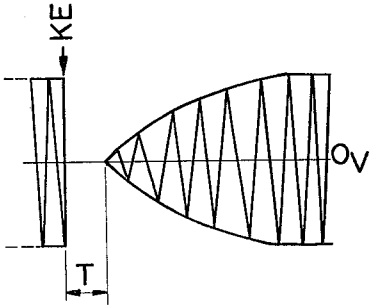
FIG. 4
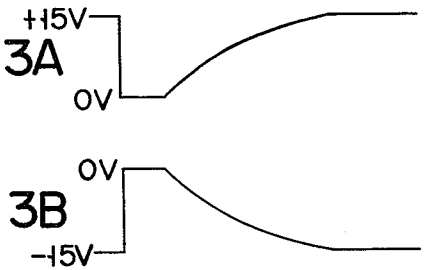
FIG. 3A
FIG. 3B
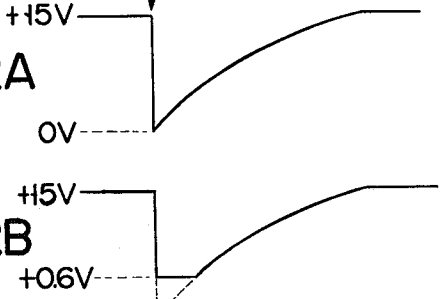
FIG. 2A
FIG. 2B

DELAYED VIBRATO ARRANGEMENT FOR AN ELECTRONIC MUSICAL INSTRUMENT

BACKGROUND OF THE INVENTION

The present invention relates to a vibrato signal generating arrangement for an electronic musical instrument.

An electronic musical instrument is generally accompanied with a vibrato device. In the electronic musical instrument, it is more preferably to add vibrato after the lapse of a relatively short time from key depression and then increase such vibrato gradually than to add vibrato immediately after key depression. The former vibrato is known as the delayed vibrato. In such delayed vibrato, a clear tone pitch of the depressed key may be obtained at time of key depression.

A typical example of existing delayed vibrato devices is provided with a series combination of a resistor and a capacitor connected between a DC power supply and the ground, an astable multivibrator for generating vibrato signals connected in parallel with the capacitor with one end connected the ground, a one-shot multivibrator triggered by a trigger pulse obtained at key depression to generate an output pulse with a predetermined duration, and a switch circuit connected in parallel with the capacitor and allowed to conduct by the output pulse from the one-shot multivibrator.

According to the aforesaid vibrator device, the capacitor discharges for the duration (about 100 ms) of the output pulse from the one-shot multivibrator, and thus the astable multivibrator generates no vibrator signal. After dissipation of the output pulse from the one-shot multivibrator, the capacitor charges gradually. On start of charging of the capacitor, the astable multivibrator starts to oscillate and generate an output signal with an amplitude depending on the voltage across the capacitor. Namely, the output amplitude of the astable multivibrator increases gradually.

The above-mentioned vibrato device has a somewhat complicated construction due to the provision of the one-shot multivibrator. The output amplitude of the astable multivibrator fluctuates between the supply voltage and the ground potential. Therefore, the DC level at the output of the astable multivibrator fluctuates while the output amplitude of the astable mulitivibrator varies. Thus, even though the astable multivibrator is coupled to a tone generator through a coupling capacitor, the average pitch of a tone generated will vary due to the fluctuation of the DC level.

SUMMARY OF THE INVENTION

An object of the present invention is to provide an improved delayed vibrato signal generating arrangement for an electronic musical instrument.

Another object of this invention is to provide a delayed vibrato signal generating arrangement simple in construction for an electronic musical instrument.

Still another object of this invention is to provide a delayed vibrato signal generating arrangement capable of generating a vibrato signal free from fluctuations of DC level.

The vibrato signal generating arrangement according to this invention is characterized by a combination of envelope signal generating means to generate an envelope signal which changes from a first potential to a second potential level at the instant of key depression and thereafter changes gradually from the second potential level to the first potential level, clipping means for clipping off the peak portion of the envelope signal, and vibrato signal generating means driven by the output of the clipping means to generate a vibrato signal having an amplitude varied gradually according to the output envelope of the clipping means, the vibrato signal generating means being so arranged as not to operate at the clipped level of the output of the clipping means.

BRIEF DESCRIPTION OF THE DRAWINGS

FIG. 1 illustrates a vibrato signal generating arrangement according to an embodiment of this invention;

FIG. 2A is a waveform diagram of an envelope signal generated by the envelope signal generator as shown in FIG. 1;

FIG. 2B is a waveform diagram illustrative of the operation of the clipper as shown in FIG. 1;

FIGS. 3A and 3B illustrate the output waveforms of an in-phase amplifier and an inverting amplifier as shown in FIG. 1 respectively; and FIG. 4 is an output waveform diagram of the vibrato oscillator as shown in FIG. 1.

DETAILED DESCRIPTION OF THE PREFERRED EMBODIMENT

Referring now to FIG. 1, an input terminal 11 is coupled to a −15 V supply through a resistor R1, and is also coupled with a trigger pulse or key depression representative pulse 12 generated by key depression which rises from −15 V to +15 V. A circuit means for generating such trigger pulse 12 is well-known and not shown. The trigger pulse 12 is coupled through a resistor R2 to the anode of a diode D1 with the cathode coupled to the base of a transistor Q1 forming a switching circuit 13. The base of transistor Q1 is connected to ground through a resistor R3, while the emitter thereof is connected directly to ground. The collector of transistor Q1 is coupled to a +15 V supply through resistors R4 and R5 and a variable resistor VR1. Between the junction between the resistors R4 and R5 and ground is connected a capacitor C1 forming a time constant circuit 14 together with the resistors R5 and VR1. The switching circuit 13 and the time constant circuit 14 compose and envelope signal generator circuit. The output of the envelope signal generator circuit or the junction between the resistor R5 and the capacitor C1 is coupled to the anode of a silicon diode D2 forming a clipper 15.

The output of the clipper 15 or the cathode of the diode D2 is coupled to the noninverting input of an operational amplifier OP1 forming an in-phase amplifier 16 as well as to the inverting input of an operational amplifier OP2 forming an inverting amplifier 17. The output of the operational amplifier OP1 is connected to ground through resistors R6 and R7, while the junction between both these resistors is coupled to the inverting input of the operational amplifier OP1. The output of the operational amplifier OP2 is coupled to its inverting input through a resistor R8, while its noninverting input is connected to the ground through a resisitor R9.

The outputs of the in-phase amplifier 16 and the inverting amplifier 17 function as positive- and negative-power supplies for vibrato oscillator 18. The vibrato oscillator 18 is provided with an operational amplifier OP3, a capacitor C2 connected between the inverting input of the amplifier OP3 and ground, a variable resistor VR2 and a resistor R10 connected in series between the inverting input and the output of the operational amplifier OP3, resistors R11 and R12 connected in series between the output of the operational amplifier OP3 and ground and having the junction therebetween connected to the noninverting input of the amplifier OP3.

An N-channel depletion-type field-effect transistor Q2 is connected in parallel with the capacitor C2. The gate of transistor Q2 is connected to the anode of a diode D3 with the cathode connected to the input terminal 11 through a resistor R13, and connected to ground through a resistor R14. The output of the vibrato oscillator 18 or the inverting input of the operational amplifier OP3 is connected to the noninverting input of an operational amplifier OP4, while the output of the amplifier OP4 is conncted to ground through resistors R15 and R16 connected in series with the junction therebetween connected to the inverting input of the amplifier OP4. Further, the output of the operational amplifier OP4 is coupled to a tone generator through a vibrator selection switch not shown.

In the operation of the vibrato device as shown in FIG. 1, the capacitor C1 is charged to a level of +15 V when the transistor Q1 is nonconducting. When the trigger pulse 12 is applied to the base of transistor Q1 at the instant of key depression, the transistor Q1 conducts. Consequently, the capacitor C1 is discharged rapidly to the ground potential level through the resistor R4 and the transistor Q1. When the trigger pulse 12 disappears, the transistor Q1 is rendered nonconducting. Accordingly, the capacitor C1 is gradually charged toward the potential level of +15 V through the resistors VR1 and R5 with the time constant of the time constant circuit 14 which may be altered by the variable resistor VR1. Apparently, as illustrated in FIG. 2A by the envelope signal generator as shown in FIG. 1, there is generated an envelope signal which changes from +15 V to 0 V at the instant of key depression and thereafter varies gradually from 0 V level to +15 V level.

A portion of the envelope signal below a potential level of +0.6 V, as shown in FIG. 2B, is clipped off by the clipper 15 including the silicon diode D2 with a cut-in voltage of about 0.6 V, and a waveform as indicated by the solid line is obtained. In the clipper as shown in FIG. 1, the clipped level at the output of the clipper 15 corresponds to the ground potential level.

From the in-phase amplifier 16 and the inverting amplifier 17 connected to the clipper 15 and having the same voltage gain, there are obtained output waveforms which have the ground potential level and are symmetrical with respect to such ground potential level as shown in FIGS. 3A and 3B. The vibrato oscillator 18 is powered from the output voltages of the in-phase and inverting amplifiers 16 and 17 to perform oscillating operation. During the oscillating operation, the capacitor C2 is alternately subjected to repeated charge and discharge, and the level of the capacitor C2 voltage or oscillator output voltage is in proportion to the difference between the output voltages of the in-phase and inverting amplifiers 16 and 17.

There will be given a detailed description of the operation of the vibrator oscillator 18. Under the normal condition, the diode D3 is conducting, so that the gate of transistor Q2 is biased negative beyond the threshold voltage and thus the transistor Q2 is nonconducting. The diode D3 is rendered nonconducting by the trigger pulse 12 to bias the gate of the transistor Q2 to the ground potential, thereby allowing the transistor Q2 to conduct. Consequently, the capacitor C2 discharges through the transistor Q2 to reset the output voltage of the vibrato oscillator 18 to 0 V. In this state, if the output A of the operational amplifier OP3 when powered is positive, the noninverting input potential or the potential at point B is also positive. As a result, since the inverting input is at the ground potential level, the output of the operational amplifier OP3 instantaneously reaches the output voltage of the in-phase amplifier 16. Thereafter, the capacitor C2 is gradually charged by the output voltage of the operational amplifier OP3 through the resistors R10 and VR2. When the voltage at the capacitor C2 is equalized to the input voltage on the noninverting input, the output A of the operational amplifier OP3 is switched over to the negative output voltage of the inverting amplifier 17. Thus, the capacitor C2 discharges through the resistors R10 and VR2. When the potentials at the noninverting and inverting inputs of the amplifier OP3 is equalized to each other as a result of such discharging of the capacitor C2, the output A of the amplifier OP3 is again switched over to the positive output voltage of the in-phase amplifier 16. Thereafter, such operation is repeated, and the vibrato oscillator 18 oscillates at a frequency depending on the output voltage of the amplifier OP3, the resistor R10, variable resistor VR2, and capacitor C2. The oscillating frequency of the vibrato oscillator 18 may be changed by the variable resistor VR2. As shown in FIG. 4, the output of the vibrato oscillator 18 has an amplitude varying with the envelope of the output voltage of the in-phase and inverting amplifiers and a frequency increasing with the increase of the difference between the output voltages of the in-phase and inverting amplifiers. The time interval T (about 100 ms) from key depression to actuation of the vibrato oscillator 18 may be adjusted by means of the variable resistor VR1 in the time constant circuit 14. It is to be understood that the average DC level at the output of the vibrato oscillator 18 is 0 V.

The output of the vibrato oscillator 18 is coupled to the tone generator through the high input impedance buffer amplifier OP4, so that the tone signal is frequency-modulated in the conventional method to provide a vibrato effect.

What is claimed is:

1. A vibrato signal generating arrangement for an electronic musical instrument comprising:

envelope signal generating means for generating an envelope signal which changes from a first potential level to a second potential level in response to and at the instant of key depression, and thereafter changes gradually from said second potential level to said first potential level;

clipping means coupled to said envelope signal generating means and having a predetermined clipping level between said first and second potential levels for clipping off a portion of said envelope signal between said second potential level and said clipping level; and vibrato signal generating means coupled to said clipping means and driven directly by the output of said clipping means so as to be operative to produce a vibrato signal, said vibrato signal generating means being so arranged that it does not operate at a signal level of the output of said clipping means corresponding to said clipping level and produces the vibrato signal in response to a signal level of the output of said clipping means other than the signal level corresponding to said clipping level and at an amplitude in accordance with the signal level of the output of said clipping means.

2. The arrangement according to claim 1, wherein said envelope signal generating means includes means for receiving a trigger pulse which is generated in response to key depression, a series combination of a resistor and a capacitor connected across a DC voltage source, and a switching circuit connected in parallel with said capacitor and rendered conductive in response to application of said trigger pulse.

3. The arrangement according to claim 1, wherein said clipping means includes a diode.

4. A vibrato signal generating arrangement for an electronic musical instrument comprising:

envelope signal generating means for generating an envelope signal which changes from a first potential level to a second potential level in response to and at the instant of key depression, and thereafter changes gradually from said second potential level to said first potential level;

clipping means coupled to the output of said envelope signal generating means and having a predetermined clipping level between said first and second potential levels for clipping off a portion of said envelope signal between said second potential level and said clipping level;

means coupled to the output of said clipping means for generating first and second control signals having a common level corresponding to a clipped level of the output of said clipping means and symmetrical waveforms with respect to said common level which are similar to the output of said clipping means; and vibrato signal generating means coupled to said means for generating said first and second control signals and driven directly by said first and second control signals for generating a vibrato signal with an amplitude proportional to the potential difference between said first and second control signals.

5. The arrangement according to claim 4, wherein said, envelope signal generating means includes means for receiving a trigger pulse which is generated in response to key depression, a series combination of a resistor and a capacitor connected across a DC voltage source, and a switching circuit connected in parallel with said capacitor and rendered conductive in response to application of said trigger pulse.

6. The arrangement according to claim 4, wherein said clipping means includes a diode.

7. The arrangement according to claim 4, wherein said first and second control signal generating means includes an in-phase amplifier and an inverting amplifier.

8. A vibrato signal generating arrangement for an electronic musical instrument comprising:

envelope signal generating means for generating an envelope signal which changes from a first potential level to a second potential level in response to and at the instant of key depression, and thereafter changes gradually from said second potential level to said first potential level;

clipping means coupled to the output of said envelope signal generating means and having a predetermined clipping level between said first and second potential levels for clipping off only a portion of said envelope signal between said second potential level and said clipping level;

means coupled to the output of said clipping means for generating first and second control signals having a reference potential level corresponding to the clipped level of output of said clipping means and opposite polarity to each other except for said reference potential level, said control signals having a waveform similar to the output of said clipping means; and vibrato oscillator means coupled to said means for generating said first and second control signals and powered from said first and second control signals for generating a vibrato signal with an amplitude proportional to the potential difference between said first and second control signals.

9. The arrangement according to claim 8, wherein said envelope signal generating means includes means for receiving a trigger pulse which is generated in response to key depression, a series combination of a resistor and a capacitor connected across a DC voltage source, and a switching circuit connected in parallel with said capacitor and rendered conductive in response to application of said trigger pulse.

10. The arrangement according to claim 8, wherein said clipping means includes a diode.

11. The arrangement according to claim 8, wherein said means for generating said first and second control signals includes an in-phase amplifier and an inverting amplifier.

12. The arrangement according to claim 8, wherein said vibrato oscillator means includes a capacitor and means for repeatedly and alternately charging and discharging said capacitor to provide an oscillation signal.

13. The arrangement according to claim 12, wherein said charging and discharging means is connected in parallel with said capacitor and is responsive to key depression to discharge said capacitor at the instant of key depression.

14. The arrangement according to claim 8, wherein said vibrato oscillator means includes an operational amplifier having a output, first and second inputs, and first and second power supply terminals connected to receive said first and second control signals respectively, a first resistor connected between the first input and the output of said operational amplifier, second and third resistors connected in series between the output of said operational amplifier and a reference potential level point, the junction between said second and third resistors being connected to the second input of said operational amplifier, and a capacitor connected between the first input of said operational amplifier and said reference potential level point.

* * * * *